United States Patent [19]

Kramer et al.

[11] 4,223,250

[45] Sep. 16, 1980

[54] PROTECTIVE COATINGS FOR LIGHT SOURCES

[75] Inventors: Jerry M. Kramer; Paul O. Haugsjaa, both of Acton, Mass.

[73] Assignee: GTE Laboratories Incorporated, Waltham, Mass.

[21] Appl. No.: 972,534

[22] Filed: Dec. 22, 1978

[51] Int. Cl.[2] ..... H05B 41/16; H05B 41/24

[52] U.S. Cl. ..... 315/248; 313/110; 313/54; 315/39; 315/344

[58] Field of Search ..... 315/248, 39, 57, 344; 313/54, 110, 312

[56] References Cited

U.S. PATENT DOCUMENTS

| | | | |
|---|---|---|---|
| 3,005,102 | 10/1961 | MacHutchin et al. | 313/54 X |
| 3,109,960 | 11/1963 | Bell et al. | 315/248 |
| 3,648,100 | 3/1972 | Goldie et al. | 315/39 |
| 3,705,319 | 12/1972 | Goldie et al. | 313/54 |
| 3,928,781 | 12/1975 | Edwards et al. | 313/54 |
| 4,010,400 | 3/1977 | Hollister | 315/248 |
| 4,117,378 | 9/1978 | Glascock, Jr. | 315/248 |
| 4,119,889 | 10/1978 | Hollister | 315/248 |

*Primary Examiner*—Saxfield Chatmon, Jr.
*Attorney, Agent, or Firm*—William R. McClellan

[57] ABSTRACT

A metallic coating is disposed on the inner surface of a lamp having an envelope made of a light transmitting substance enclosing a fill material which emits light upon breakdown and excitation by a high frequency power source. The metallic coating protects the lamp envelope from degradation caused by the lamp fill material or by products of the discharge and acts as a catalyst for the recombination reaction of molecular lamp fill material. A nickel coating is used in a deuterium discharge lamp. Another suitable metal is gold. The metallic coating is sufficiently thin to permit high frequency power to pass through the coating.

19 Claims, 2 Drawing Figures

PROTECTIVE COATINGS FOR LIGHT SOURCES

BACKGROUND OF THE INVENTION

This invention relates to electromagnetic discharge apparatus and in particular to electrodeless light sources which have a metallic coating on the inner surface of the lamp envelope to protect the lamp envelope from degradation caused either by the lamp fill or by products of the discharge and to act as a catalyst for the recombination reaction of molecular lamp fill material.

electrodeless light sources which operate by coupling high frequency power, typically 915 MHz, to a discharge in an electrodeless lamp have been developed. These light sources typically include a high frequency power source connected to a termination fixture with an inner conductor and an outer conductor surrounding the inner conductor as described in U.S. Pat. No. 3,942,058 issued Mar. 2, 1976 to Haugsjaa et al. and U.S. Pat. No. 3,943,403 issued Mar. 9, 1976 to Haugsjaa et al. The electrodeless lamp is positioned at the end of the inner conductor and acts as a termination load for the fixture. The termination fixture has the function of matching the impedance of the electrodeless lamp during discharge to the output impedance of the high frequency power source. The electrodeless lamp envelope is made of a transparent substance and encloses a fill material which emits light upon breakdown and excitation.

Various other electrodeless discharge devices have been described in the prior art, for example, U.S. Pat. No. 4,010,400 issued Mar. 1, 1977 to Hollister and U.S. Pat. No. 3,787,705 issued Jan. 22, 1974 to Bolin et al., U.S. Pat. No. 3,873,884 issued Mar. 25, 1975 to Gabriel, U.S. Pat. No. 3,872,349 issued Mar. 18, 1975 to Spero et al., and "Microwave Discharge Atom Source for Chemical Lasers", R. A. McFarlane, *Rev. Sci. Instrum.*, Vol. 46, No. 8, August 1975.

Although most electrodeless lamps are filled with an inert gas and envelope-compatible substances such as mercury, it is sometimes desirable to use fill materials which attack the lamp envelope. One example of a material which attacks the lamp envelope is found in low pressure electrodeless deuterium discharges. The deuterium discharge is normally used as an ultra-violet continuum source in spectrophotometers. Because of the reaction between deuterium atoms and the quartz envelope, the life of the light source is low.

Electroded deuterium light sources which are presently in commercial use are unsatisfactory because of poor stability of light output. In addition, the lifetime is on the order of 125 hours as a result of a reaction between the deuterium fill material and both the electrodes and the quartz envelope.

Conventional methods of protecting lamp envelopes from reactive fill materials have emphasized the use of an envelope material which is compatible with the fill material. For example, glasses which contain boric oxide are resistant to sodium attack. Current low-pressure sodium lamps contain an inner liner of borate glass. In the case of high pressure sodium lamps, an alumina envelope is used. It would be desirable to use a common envelope material for many types of discharge lamps. Quartz, for example, is desirable because of its high temperature properties and its ease of sealing and shaping.

In addition to the above-mentioned patents, the following U.S. patents, which may be of interest, relate to electrodeless lamps, at least one of the patentees of each patent is an applicant of this application, and all patents have been assigned to the assignee of the present application.

| U.S. Pat. No. | Patentee | Issue Date |
|---|---|---|
| 3,942,068 | Haugsjaa et al. | March 2, 1976 |
| 3,943,401 | Haugsjaa et al. | March 9, 1976 |
| 3,943,402 | Haugsjaa et al. | March 9, 1976 |
| 3,943,404 | McNeill et al. | March 9, 1976 |
| 3,993,927 | Haugsjaa et al. | November 23, 1976 |
| 3,995,195 | Haugsjaa et al. | November 30, 1976 |
| 3,997,816 | Haugsjaa et al. | December 14, 1976 |
| 4,001,631 | McNeill et al. | January 4, 1977 |
| 4,001,632 | Haugsjaa et al. | January 4, 1977 |
| 4,002,943 | Regan et al. | January 11, 1977 |
| 4,002,944 | McNeill et al. | January 11, 1977 |
| 4,041,352 | McNeill et al. | August 9, 1977 |
| 4,053,814 | Regan et al. | October 11, 1977 |
| 4,065,701 | Haugsjaa et al. | December 27, 1977 |
| 4,070,603 | Regan et al. | January 24, 1978 |

PRIOR ART STATEMENT

The subject matter set forth hereinabove constitutes prior art which includes, in the opinion of the applicants and their attorney, the closest prior art of which they are aware. This prior art statement shall not be construed as a representation that a search has been made or that no better art exists.

SUMMARY OF THE INVENTION

It is an object of the present invention to provide improved electrodeless light sources.

It is another object of the present invention to provide electrodeless light source in which the lamp-envelope is protected from reaction with the lamp fill material or with products of the discharge in the lamp.

It is another object of the present invention to provide electrodeless light sources in which the inner surface of the lamp envelope acts as a catalyst for the recombination-reaction of molecular lamp fill material.

It is another object of the present invention to provide electrodeless light sources which have long life.

In accordance with the present invention, a lamp for use in an electromagnetic discharge apparatus has a lamp envelope made of a light transmitting substance enclosing a fill material which emits light during electromagnetic discharge. The lamp envelope has a metallic coating disposed on its inner surface. The lamp can be electrodeless. The metallic coating is normally of a thickness to permit high frequency power to pass through said coating and has a melting point higher than the operating temperature of the lamp.

The metallic coating can be operative to protect the lamp envelope from degradation caused by the fill material or by products of the discharge. The metallic coating can also be operative to act as a catalyst for the recombination reaction of molecular fill material during discharge. The metallic coating can also be operative to perform both of the aforementioned functions.

According to another feature of the present invention, an electromagnetic discharge apparatus includes lamp means having a lamp envelope made of a light transmitting substance. The lamp envelope encloses a fill material which emits light during electromagnetic discharge and has an inner surface with a metallic coating disposed thereon. The apparatus also includes means for excitation of said fill material coupled to said lamp means and adapted for delivering high frequency power to said lamp means for sustaining the electromagnetic discharge. The means for excitation of the fill material can include transmission line means having a first end for receiving high frequency power and a second end coupled to said lamp means so that said lamp means forms a termination load for high frequency power propagating along said transmission line means.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
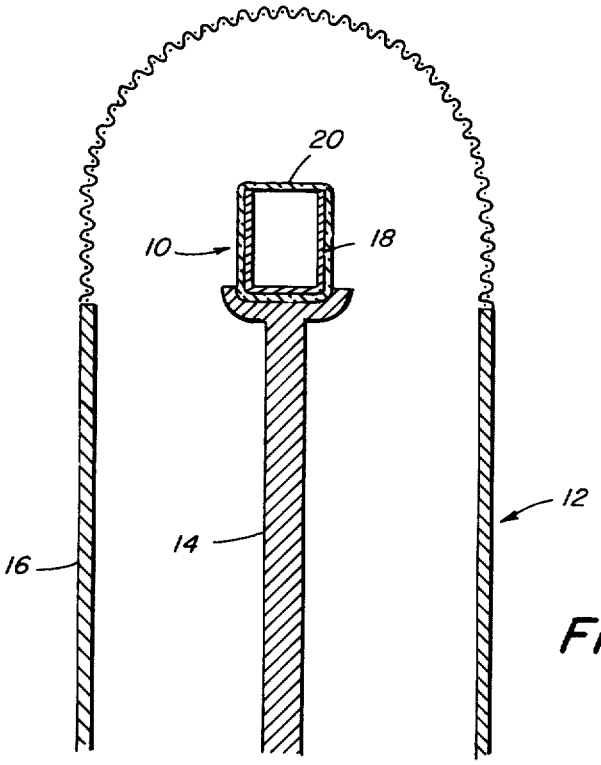
FIG. 1 is a partial cross-section of an electrodeless light source according to the present invention.

As shown in FIG. 1, an electromagnetic discharge apparatus, typically an electrodeless light source, includes an electrodeless lamp 10 and means for excitation of the lamp fill material, illustrated as a termination fixture 12. The termination fixture typically includes a transmission line adapted for delivering high frequency power to the discharge with the electrodeless lamp 10 acting as a termination load and can include a high frequency power source. The excitation means is coupled to the electrodeless lamp 10. The electrodeless lamp 10 has an envelope made of a transparent substance such as quartz. The lamp envelope encloses a fill material which emits light upon breakdown and excitation by a high frequency power source. The termination fixture 12 includes an inner conductor 14 and an outer conductor 16 disposed around the inner conductor 14. The electrodeless lamp 10 is mounted at the second end of the inner conductor 14. The first end of each conductor is adapted for connection to a high frequency power source (not shown). The frequency of the power source is in the range from 100 MHz to 300 GHz and is preferably in the ISM (Instrument, Scientific and Medical) band from 902 MHz to 928 MHz. Details of the construction of electrodeless light sources have been shown in U.S. Pat. No. 3,942,058 and U.S. Pat. No. 3,943,403. A high frequency power source is described in U.S. Pat. No. 4,070,603 issued Jan. 24, 1978 to Regan et al.

In the present invention, a thin metallic coating 18 is disposed on the inner surface of the electrodeless lamp 10. As described hereinabove, certain fill materials react with the envelope material of the electrodeless lamp 10. The reaction results not only in loss of fill material but also in impurities which adversely affect the spectrum of the light source output and thereby reduce the useful life of the light source.

One example of a lamp fill material which attacks a quartz envelope is deuterium. The deuterium discharge dissociates deuterium molecules into deuterium atoms which recombine into molecules on the quartz walls of the lamp envelope. Since the recombination of deuterium atoms on quartz is very inefficient, and since deuterium atoms are reactive toward quartz, the deuterium reacts with quartz to liberate oxygen or an oxygen containing species. The reaction between deuterium atoms and quartz may be described by the following equations:

$$4D + SiO_2 \rightarrow Si + 2D_2O; \text{ or}$$

$$2D + SiO_2 \rightarrow SiO + D_2O$$

These oxygen species manifest themselves in the discharge as an OD (deuterium monoxide radical) impurity spectral band in the ultraviolet. As time passes, the OD impurity band dominates the ultraviolet spectrum and the lamp is no longer useful as an ultraviolet source.

Figure 2:
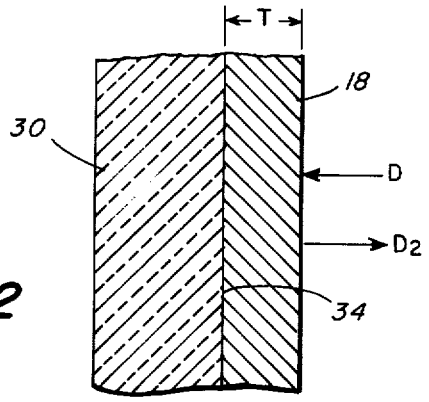
FIG. 2 is a partial cross-section of an electrodeless lamp according to the present invention illustrating the details of the metallic coating.

The metallic coating 18 acts as a barrier between the lamp envelope material and the fill material. Referring now to FIG. 2, a magnified partial cross-section of the electrodeless lamp envelope is illustrated. The lamp envelope has a metallic coating 18 of thickness T on the inner surface of the lamp envelope 30. In the case of deuterium light source, the metallic coating 18 performs two functions. First, it protects the lamp envelope against degradation caused by the fill material or by products of the discharge, such as deuterium atoms. Second, the metallic coating 18 serves as a catalyst for the recombination of deuterium atoms into deuterium molecules. The concentration of deuterium atoms is therefore reduced near the lamp envelope 30. The recombination is illustrated in FIG. 2 by deuterium atoms, D, generated by the discharge, being recombined at the surface of the coating 18 into deuterium molecules, $D_2$.

The metallic coating in electrodeless light sources with other fill materials can be operative to perform one or the other but not necessarily both of the aforementioned functions. Another example of a discharge lamp fill material that attacks quartz is metallic sodium. Conventional sodium lamps employ alumina envelopes. A quartz envelope can be used if protected against sodium attack by a tantalum coating according to the present invention. In this case, the tantalum does not act as a catalyst in a recombination reaction.

There are several requirements placed on the metallic coating 18 for the electrodeless lamp. First, the coating 18 must be thin enough to permit high frequency power to pass through the coating into the lamp fill material. This requirement is met if the thickness, T, of the coating 18 is less than the skin depth of the metal at the frequency of operation. Skin depth is a well known quantity which is related to the fact that high frequency power travels near the surface of a conductor rather than being uniformly distributed in the conductor. Skin depth is a measure of the depth to which the high frequency power penetrates the conductor and is given by the following formula:

$$\text{skin depth} = [\pi f \mu_o \mu \sigma]^{-\frac{1}{2}}$$

Where $f$ = the frequency of operation of the light source $\mu_o$ = the permittivity of free space $\mu$ = the permittivity of the metal $\sigma$ = the conductivity of the metal For a nickel coating and a typical operating frequency of 915 MHz, the skin depth is about 2150 Angstroms. If the coating has no window for passage of light from the lamp, the thickness of the coating must also be less than the wavelength of the output light in order to transmit light from the lamp. A second requirement is that the metal used for the coating have a melting point higher than the operating temperature of the light source, which is typically less than 750° C. Finally, the metallic coating 18 can not cause impurity spectral lines in the spectral region of interest. The invention is best suited for electrodeless light sources excited by high frequency power since the metallic coating would cause an electrical short at low frequencies or dc.

In the case of the deuterium lamp, the best success has been achieved using a nickel coating of approximately 500 Angstroms thickness. Deuterium lamps with a nickel coating have demonstrated life-times more than 25 times greater than uncoated lamps. As shown in FIG. 1, the upper end 20 of an electrodeless lamp 10 was left uncoated for transmission of light. The remainder of the inner surface had a nickel coating 18. It was determined that the large surface area of metal in close proximity to the uncoated area served to protect the uncoated area by effectively recombining and reducing the concentration of deuterium atoms near the lamp envelope. Thus, the metallic coating disclosed in this invention is effective whether or not it entirely covers the inner surface of the lamp and windows can be left in the coating for more effective transmission of light. Another metal which has successfully been used as a coating in deuterium lamps is gold. Tungsten or molybdenum can also be used as a lamp coating, but these metals cause spectral impurity lines in deuterium lamps. Other metals can be used depending on the lamp fill material and the lamp operating temperature.

Application of the metallic coating has been accomplished by an evaporative process. A small amount of the metal is placed inside the lamp envelope which is then sealed. When a discharge is run in the lamp, the metal forms a coating on the inner surface of the lamp. After the coating reaches the desired thickness, the lamp envelope is opened, the remaining metal is removed, deuterium is reintroduced into the envelope, and the envelope is resealed.

The present invention permits a common envelope material to be used with a variety of reactive fill materials. Quartz, for example, is desirable because of its high temperature properties and its case of sealing and shaping.

While there has been shown and described what is at present considered the preferred embodiment of the invention, it will be obvious to those skilled in the art that various changes and modifications may be made therein without departing from the scope of the invention as defined by the appended claims.

What is claimed is:

1. A lamp for use in an electromagnetic discharge apparatus, said lamp comprising:

a lamp envelope made of a light transmitting substance and having an inner surface;

a fill material which emits light during electromagnetic discharge, said fill material being enclosed by said lamp envelope; and a metallic coating disposed on the inner surface of said lamp envelope such that said coating is exposed to said fill material.

2. The lamp as defined in claim 1 wherein said lamp is electrodeless and said metallic coating is of a thickness to permit high frequency power to pass through said coating and has a melting point higher than the operating temperature of said lamp.

3. The lamp as defined in claim 2 wherein the metallic coating is less than one skin depth in thickness, said skin depth being determined at the operating frequency of said lamp.

4. An electromagnetic discharge apparatus comprising:

lamp means having a lamp envelope made of a light transmitting substance, said envelope enclosing a fill material which emits light during electromagnetic discharge and having an inner surface with a metallic coating disposed thereon, such that said metallic coating is exposed to said fill material; and means for excitation of said fill material coupled to said lamp means and adapted for delivering high frequency power to said lamp means for sustaining said electromagnetic discharge.

5. The electromagnetic discharge apparatus as defined in claim 4 wherein said lamp means is electrodeless and said metallic coating is of a thickness to permit high frequency power to pass through said coating and has a melting point higher than the operating temperature of said lamp means.

6. The electromagnetic discharge apparatus as defined in claim 5 wherein said means for excitation of said fill material includes transmission line means having a first end for receiving high frequency power and a second end coupled to said lamp means so that said lamp means forms a termination load for high frequency power propagating along said transmission line means.

7. The electromagnetic discharge apparatus as defined in claim 6 wherein said means for excitation of said fill material further includes high frequency power means coupled to the first end of said transmission line means.

8. The electromagnetic discharge apparatus as defined in claim 7 wherein said transmission line means includes a termination fixture having an inner conductor and an outer conductor disposed around the inner conductor.

9. The electromagnetic discharge apparatus as defined in claim 6 wherein the metallic coating is operative to protect said lamp envelope from degradation caused by said fill material or by products of said discharge.

10. The electromagnetic discharge apparatus as defined in claim 9 wherein the metallic coating includes tantalum and one of the fill materials is metallic sodium.

11. The electromagnetic discharge apparatus as defined in claim 6 wherein said fill material is molecular in nature and undergoes a recombination reaction during discharge and the metallic coating is operative to act as a catalyst for said recombination reaction.

12. The electromagnetic discharge apparatus as defined in claim 11 wherein the metallic coating is operative to protect said lamp envelope from degradation caused by said fill material or byproducts of said discharge.

13. The electromagnetic discharge apparatus as defined in claim 12 wherein the metallic coating is less than one skin depth in thickness, said skin depth being determined at the operating frequency of said high frequency power source.

14. The electromagnetic discharge apparatus as defined in claim 12 wherein the metallic coating is about 500 Angstroms thick.

15. The electromagnetic discharge apparatus as defined in claim 12 wherein the metallic coating includes a metal selected from the group consisting of nickel and gold.

16. The electromagnetic discharge apparatus as defined in claim 15 wherein the fill material for said electrodeless lamp includes deuterium.

17. The electromagnetic discharge apparatus as defined in claim 6 wherein the metallic coating entirely covers the inner surface of said electrodeless lamp means and is of a thickness to transmit light.

18. The electromagnetic discharge apparatus as defined in claim 6 wherein the metallic coating partially covers the inner surface of said electrodeless lamp means thereby leaving an uncoated portion of said inner surface through which light is transmitted.

19. The electromagnetic discharge apparatus as defined in claim 6 wherein the lamp envelope is made of quartz.

* * * * *